United States Patent [19]

Mannhart

[11] 4,168,604

[45] Sep. 25, 1979

[54] METHOD AND APPARATUS FOR EVALUATING YARN SIGNALS BASED ON THE DETECTION OF AT LEAST APPROXIMATELY PERIODIC VARIATIONS IN CROSS SECTION

[75] Inventor: Werner Mannhart, Uster, Switzerland

[73] Assignee: Zellweger, Ltd., Switzerland

[21] Appl. No.: 878,782

[22] Filed: Feb. 17, 1978

[30] Foreign Application Priority Data

Mar. 22, 1977 [CH] Switzerland ..... 3546/77

[51] Int. Cl.[2] ..... D01H 13/22

[52] U.S. Cl. ..... 57/264; 57/265; 73/160

[58] Field of Search ..... 57/34 R, 81, 58.89, 57/156, 264, 265; 324/61 R, 71 R, 77 H; 340/677; 19/0.2–0.23; 242/36, 49; 226/45; 73/160; 28/227

[56] References Cited

U.S. PATENT DOCUMENTS

| | | | |
|---|---|---|---|
| 2,641,960 | 6/1953 | Strother | 73/160 X |
| 3,069,621 | 12/1962 | Berttecaz | 324/61 R |
| 3,731,069 | 5/1973 | Goto et al. | 28/227 X |
| 4,051,722 | 10/1977 | Feller | 73/160 |
| 4,058,962 | 11/1977 | Spescha et al. | 57/34 R |
| 4,060,965 | 12/1977 | Schwartz | 57/34 R |

*Primary Examiner*—Charles Gorenstein
*Attorney, Agent, or Firm*—Craig and Antonelli

[57] ABSTRACT

An apparatus for controlling a plurality of spinning stations by evaluating yarn signals based upon detection of approximately periodic variations in yarn cross section provides for conversion of the signals to digital form and application of the digital signals to a microcomputer in which the sum of the differences between the original yarn signal and a yarn signal delayed in time is continuously formed. Specific fault signals are produced from the summed differences which are checked against predetermined reference values.

19 Claims, 8 Drawing Figures

METHOD AND APPARATUS FOR EVALUATING YARN SIGNALS BASED ON THE DETECTION OF AT LEAST APPROXIMATELY PERIODIC VARIATIONS IN CROSS SECTION

The invention relates to a method and apparatus for evaluating yarn signals based on the detection of at least approximately periodic variations in cross section of the yarn.

Nowadays, the production of textile semi-finished products, in particular, that of yarns, demands comprehensive and rapidly reacting monitoring of quality. Although conventional spinning methods allow random samples to be taken during production and tested in a testing laboratory so that the average quality of the entire delivery can be subsequently inferred according to the laws of statistics, present day production plants demand continuous monitoring of each individual spinning position so that the testing of random samples is no longer sufficient. In particular, the production of yarns on Open End (OE) spinning machines necessitates such intensive monitoring. In this process, the following types of reduction of yarn quality are to be determined:

1. Individual large thick points;
2. Chains of thick points;
3. Increased irregularity;
4. Periodic variations in cross section.

The individual large thick points are removed by the electronic yarn cleaners, which are quite conventional nowadays. Chains of thick points are a characteristic type of fault in OE spinning machines. Methods and apparatus have already been disclosed for detecting and removing them, for example, as described in Swiss Pat. No. 568,405.

In order to determine the irregularity and the periodic variations in cross section, laboratory instruments have hitherto been provided which could essentially only subject the above-mentioned random samples to examination relatively slowly and, particularly, some time after production. However, it is necessary to be able to monitor both the irregularity and the content of periodic portions therein simultaneously with the production of the yarn. This eliminates the use of expensive laboratory measuring instruments and enables simplified methods to be used for determining the characteristic quantities since guides to the quality of production may be drawn from the trend of their path without forming a maximum of accuracy in measurement and a conversion of the measured value approaching the theoretical value.

Such laboratory instruments are embodied, for example, in the "USTER" uniformity tester described in Swiss Pat. No. 249,096, the "USTER" integrator described in Swiss Pat. No. 262,827, and the "USTER" spectrograph described in Swiss Pat. No. 300,068.

The invention is therefore concerned with a suitable method of evaluation for detecting faulty yarns, in particular, periodic variations in cross section.

The starting point is the obtaining of an electric signal proportional to the cross section of the yarn for each spinning position, the signal being analyzed with regard to the above-mentioned properties, and the production of a control signal which affects the spinning process if these properties have unacceptable values. This means that for each spinning position a monitoring channel has to be provided, so that the number of monitoring channels needed is very high and the equipment correspondingly expensive.

A first simplification of this problem may be obtained by scanning the yarn signals formed not continuously but one after the other in relation to their amplitude, whereby an essential part of the evaluating device may be united in a single unit and any messages concerning faults may be allocated to the spinning position causing the fault. Several signals can be combined for processing in one center by means of multiplexers of a conventional type.

In addition, modern semiconductor technology can be used to provide integrated circuits and microcomputers which are able to overcome the complex signal processing problems involved in monitoring all the spinning positions, while only requiring a small amount of space.

With regard to the problem of determination of the periodic irregularity in the yarn signal, it is firstly essential for the length of the pronounced periods to be generally almost equal to the periphery of the rotor of the spinning unit. However, even shorter periods also appear. Since the cross section of the yarn as a function of the length is expressed as an electric signal as a function of time, the periodic portions contained in this signal depend upon the rate of travel of the yarn. It is, therefore, advantageous if the installation is not restricted with regard to the period lengths which it can detect. This means that solutions which make use of tuned filters are not possible.

One possible but expensive solution involves calculating the Fourier spectrum of the yarn signal in order to indicate the presence of periodic variations in cross section. However, the calculation of this function, also according to the known algorithm of the "rapid Fourier transformation" according to Cooley and Tukey is too protracted. The calculation period is several minutes and cannot therefore be considered.

According to the present invention, there is provided a method of evaluating yarn signals based on the detection of at least approximately periodic variations in cross section, wherein yarn signals x(t) are obtained from the cross section or diameter of the yarn by means of detectors and fed in digital form to a microcomputer in which it is firstly delayed by a time interval $(\tau_2-\tau_1)$ falling within a delay interval $(\tau)$, absolute values are formed of differences between the original yarn signal x(t) and the delayed yarn signals $(x(t-\tau))$, the said absolute values are integrated to give function values $Q(\tau)$ over a time interval T, and criteria for the presence of at least approximately periodic variations in cross section and/or for the size of the total irregularity of the yarn are obtained from the maximum and minimum values of $Q(\tau)$ appearing within the said delay interval $((\tau_2-\tau_1))$.

The invention also provides an apparatus for evaluating yarn signals based on the detection of at least approximately periodic variations in cross section, comprising an analog-digital converter for converting the yarn signals x(t) into digital signals by means of a microcomputer in which the sum of the differences between the original yarn signal x(t) and a yarn signal delayed by a time interval $\tau$ is continuously formed, the microcomputer further comprising means for producing specific fault signals from the summed difference and means for checking the fault signals against predeterminable reference values, switching means being provided which influence the spinning process if at least one reference value is exceeded.

Advantageously, a number of yarn signals are fed from different spinning positions to a multiplexer and are converted therein into consecutive partial signals. The control signals relating to individual spinning positions are allocated by a demultiplexer.

It is also advantageous if the yarn signal passes through a control amplifier which adjusts different amplitudes of the yarn signals caused by different tex values (yarn counts) to a uniform level.

Microcomputer technology allows the apparatus according to the invention to be advantageously designed so that the mathematical operations, the comparisons between fault signals and reference values as well as the emission of control signals based on the selected criteria, may be carried out in a single structural unit.

The invention is further described below with reference to the accompanying drawings, in which.

An autocorrelation function (designated ACF below) is advantageously used in accordance with the invention. For a signal x(t), the ACF is defined as follows:

$$R(\tau) = \frac{1}{T}\int_o^T (x)\cdot(t)\cdot x(t-\tau)dt \quad \text{(FIG. 1,2)} \tag{1}$$

Figure 1:
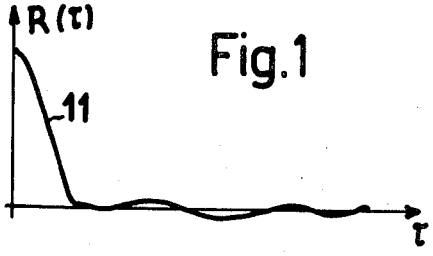
FIG. 1 shows an autocorrelation function for a stochastic signal.
Figure 2:
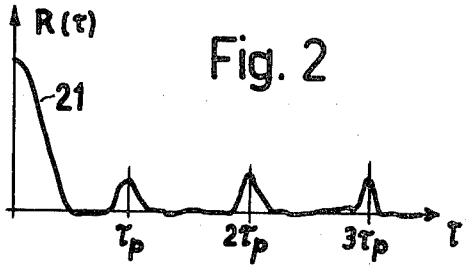
FIG. 2 shows an autocorrelation function for a stochastic signal with a periodic component.

FIG. 1 shows the ACF for a purely stochastic function and FIG. 2 shows the ACF for a stochastic function with superimposed periodic components (periodicity $\tau_p$). In order to calculate this function discretely, the integral is substituted by the sum:

$$R(\tau) = \frac{1}{N}\sum_{k=1}^{N} x(k\,\Delta\,t)\cdot x(k\,\Delta\,t-\tau) \tag{2}$$

For this purpose, the signal must be present in the form of quantized scanned values $x(k\Delta t)$. The value of $\tau$ is increased in equal discrete intervals:

Ti $\tau=0$, $\Delta t$, $2\Delta t \ldots m\Delta t$.

Calculation of this function using a microcomputer took approximately forty-five seconds for N=1000 scanned values and n=50 time interval stages. This time requirement is still too long for continuous evaluation of the yarn signal in the production process. The multiplication in equation (2) is mainly responsible for this. For each value of $\tau$, this operation must be carried out N-times, and thus, for a total of Nxm times (with the above numerical values 50,000 times). This operation requires a slot of time in a conventional microcomputer. It is therefore necessary either to use special microcomputers which are able to carry out the multiplication in a substantially shorter period or to use a simplified principle of multiplication. This may be effected, for example, by carrying out only one multiplication by $2^n$. For binary numbers, this means a shift of the number by n−1 places.

In contrast to multiplication, adding and subtracting operations may be carried out very rapidly (in a few microseconds).

Starting from the ACF and attempting to avoid time-intensive operation, the following new function Q was defined:

$$Q(t) = \int_o^T [x(t) - x(t-\tau)]\,dt \tag{3}$$

$$Q(t) = \sum_{k=1}^{N} [x(k\,\Delta\,t) - x(k\,\Delta\,t-\tau)] \tag{4}$$

Figure 3:
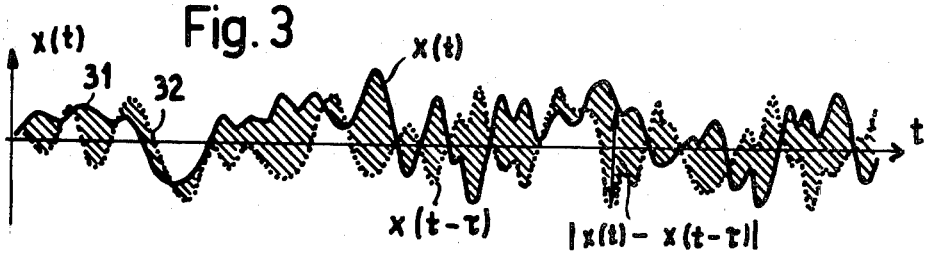
FIG. 3 is a graph showing an undelayed yarn signal and a delayed yarn signal.

This function is capable of determining periodic signals which are contained in a stochastic signal. FIG. 3 illustrates the formation of the function $Q(\tau)$. The integral of the absolute values of the difference between the original function x(t) and the function $x(t-\tau)$ displaced by $\tau$ according to equation 3 corresponds to the hatched area. For $\tau>0$, the value of the function tends towards a specific value which is independent of $\tau$.

Figure 4:
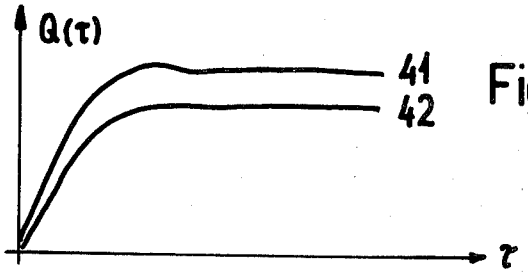
FIG. 4 is a graph showing two plots of derived magnitudes of the function of a time difference $\tau$.

FIG. 4 shows the function $Q(\tau)$ as a function of $\tau$ for two different yarns with different irregularity. The values of the function $Q(\tau)$ is a measure of the similarity between the original signal x(t) and the signal $x(t-\tau)$ delayed by $\tau$. With a stochastic signal, this value of the function $Q(\tau)$ for $\tau>0$ is independent of $\tau$. The function $Q(\tau)$ does however depend on the irregularity of the signal x(t). Thus, curve 41 corresponds to an irregular yarn (larger U% value or CV% value), while curve 42 corresponds to a more regular yarn (smaller U% or CV%).

Figure 5:
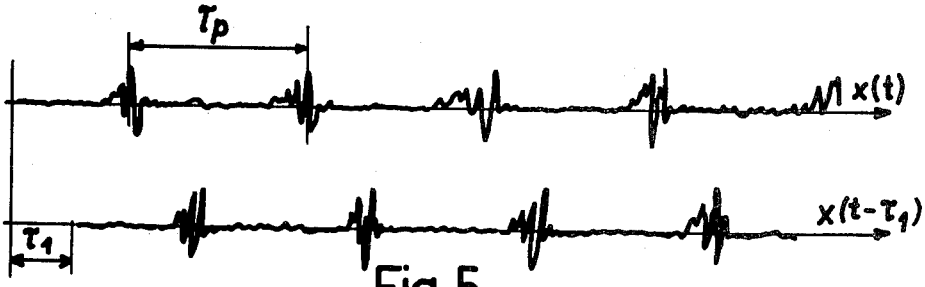
FIG. 5 is a graph of an original yarn signal and of a yarn signal delayed by a time interval $\tau_1$ as a function of time.
Figure 6:
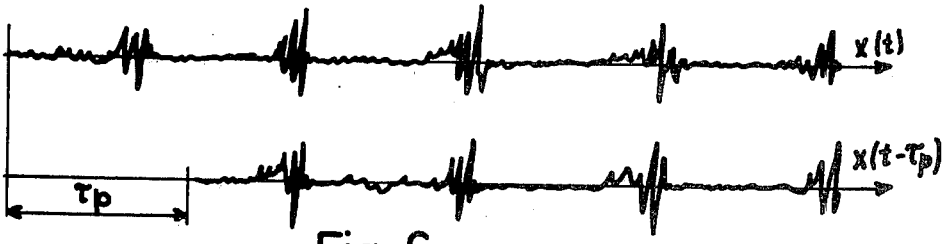
FIG. 6 is a graph of an original yarn signal and of a yarn signal delayed by a time interval $\tau_p$ as a function of time.
Figure 7:
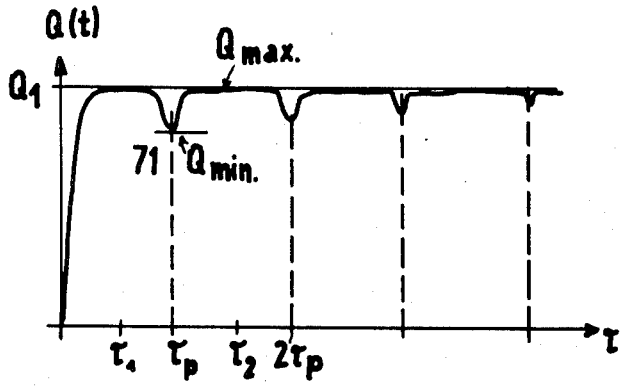
FIG. 7 is a graph of a function $Q(\tau)$.

Now if a stochastic signal is observed on which a periodic signal is superimposed then the function $Q(\tau)$ is again formed for various values of the shift $\tau$ (FIG. 5). For values $\tau<\tau_p$ a specific value of the function $Q(\tau)$ independent of $\tau$ is again obtained. However, if $\tau=\tau_p$ or, in general $\tau=n\tau_p$ (n=1, 2 . . . ), the periodic portions coincide (FIG. 6). The two curves are now rather alike, as expressed in a smaller value of the function $Q(\tau)$ for this value of $\tau$. A plot of the function $Q(\tau)$ as shown in FIG. 7 is thus obtained.

The periodicity of the periodic portion may be determined from the position, in particular, of the first dip 71. The value $Q_1$ is a measure of the irregularity of the yarn.

In order to be able to evaluate the function $Q(\tau)$ or $R(\tau)$ automatically, the following quotient is now formed:

$$MZ = \frac{Q(\tau)_{max}}{Q(\tau)_{min}}\Bigg|_{\tau_1}^{\tau_2}; \text{ or } \frac{R(\tau)_{max}}{R(\tau)_{min}}\Bigg|_{\tau_1}^{\tau_2} \tag{5}$$

i.e., the function $Q(\tau)$ is calculated in ranges from $\tau_1$ to $\tau_2$ in which periods may be expected. The ratio of the maximum and minimum value of this function is then formed in this interval. This number is a direct measure of the intensity of any periodic component in the yarn signal. As a proportion, it is practically independent of the original amplitude of the yarn signal. Tests have shown and confirmed that following values exist for MZ:

MZ<1.12 for normal yarn

MZ>1.12 for periodically irregular yarn, in whose further processing the formation of a so-called Moiré effect is probable (MZ=Moiré number).

The fact that the size of the irregularity (U% or CV%) influences the level of the asymptotic branch of the lines Q(τ) (41, 42 in FIG. 4) is evaluated by the equation:

$$UZ = \frac{1}{\tau_2 - \tau_1} \int_{\tau_1}^{\tau_2} Q(\tau) d\tau \qquad (6)$$

A value for the irregularity is thus obtained. In terms of the apparatus, this means that the function Q(τ) is to be integrated (or the average value thereof is to be formed) within the delay interval ($\tau_2-\tau_1$). This value UZ is however dependent upon the amplitude of the yarn signal.

Figure 8:
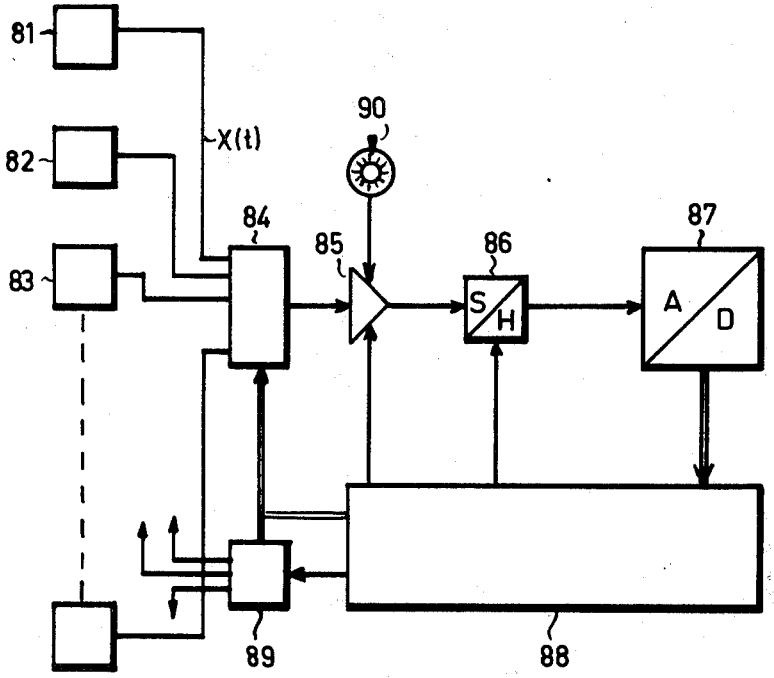
FIG. 8 is a block diagram of an apparatus according to the invention.

If an evaluation according to this function is provided, the yarn signal should be adjusted to a predetermined level by amplification control by means of a control amplifier 85, as seen in FIG. 8. In addition, care should be taken that the level of the yarn signal at the input of the microcomputer 88 is independent of the average yarn cross section (average yarn count, tex value). This may be carried out, for example, by means of a gain adjusting member 90 on the amplifier 85 which has an adjusting button with a scale calibrated in tex values which is adjusted at the beginning of the measuring process to the tex value of the test yarn.

The principle of the apparatus according to the invention is illustrated in more detail with reference to FIG. 8.

Detectors 81, 82, 83 . . . n are located at the individual spinning positions and emit yarn signals x(t) corresponding to the cross section or diameter of the yarn. These yarn signals x(t) enter a multiplexer 84 which delivers them into a row of successive individual values. This means that only one subsequent evaluating device is required for a plurality of yarn signals without an appreciable reduction in the accuracy of measurement having to be paid for by the discrete scanning of the measured values. A control amplifier 85 may follow the multiplexer 84, the amplification of the amplifier depending on the magnitude of the incoming yarn signal x(t). This control amplifier 85 advantageously has an adjusting member 90 calibrated in tex values with which comparable input signals can be transferred to further stages for different yarn numbers, as discussed above. If specific aspects of evaluation are dispensed with, the control amplifier 85 may be omitted.

The yarn signal x(t) process in this way now passes to an analog-digital converter 87, optionally via a so-called "sample and hold" stage 86. The converter 87 forms the digital signals required for further processing in the subsequent microcomputer 88 from the incoming yarn signal x(t).

The microcomputer 88 is programmed in such a way that it performs the calculating operations from the digital input signals mentioned above. In particular, it forms the function Q(τ), determines the maximum and minimum values thereof within a shift interval $\tau_2-\tau_1$ and forms a quotient MX from these values. This quotient MX is compared with a reference value in a first comparator. If the quotient exceeds the reference value, a fault signal is emitted at the output of the microcomputer which is capable of suitably influencing the respective spinning position after passing a demultiplexer 89 synchronized with the multiplexer 84. This control of the spinning position may be carried out, for example, by generating a control signal or by adjusting a spindle.

The apparatus according to the invention may also be used for at least approximate determination of the irregularity value U, if an integrator stage is provided in the microcomputer 88. The integrator stage forms the average value of the function Q(τ) over a delay interval $\tau_2-\tau_1$. This average value may be displayed or compared with another reference value. In each case, switching or signalling devices may be triggered and are able to locate the faulty spinning position as a result of a fault signal.

In the case of central evaluation of the yarn signals, it is also possible to provide predetermined adjustment of the spinning speed, the minimum operating currents of the tex value (yarn count) in groups for the monitored spindles. The values applying for each spindle are stored in the microcomputer and activated each time the respective spindle is controlled by the multiplexer.

Each time that the limit value is exceeded, the following may be displayed or may be stored for a subsequent printout:

intensity of the periodicity corresponding to the Moiré number MZ, period length which may be read from the position of the first dip of the function Q(τ) (FIG. 7), size of the irregularity corresponding to the irregularity number UZ, spindle number and time.

The microcomputer may also be additionally programmed for monitoring the yarn signal for the appearance of chains of thick points.

Another advantage of the use of microcomputers is that statistical evaluation may be carried out over a specific observation interval without high additional expense. Such statistical evaluations provide information as to the respective machine. Spindles which have a marked tendency to form Moiré yarn within a specific monitoring interval may thus be distinguished clearly.

What is claimed is:

1. A method of controlling one or more spinning stations by evaluating yarn signals based on the detection of at last approximately periodic variations in cross section of the yarn comprising the steps of generating signals representative of the cross section or diameter of the yarn by means of detectors, converting the signals to digital form, delaying the digital signals by a time interval τ lying within a predetermined delay interval, producing signals whose absolute values represent the differences between the original yarn signal and the delayed yarn signals, integrating the said absolute value signals to give signals having function values Q(τ) over a time interval T, and obtaining from the maximum and minimum values of Q(τ) appearing within the said delay interval criteria for the presence of at least approximately periodic variations in cross section and/or for the size of the total irregularity of the yarn and controlling said spinning station on the basis of said criteria.

2. A method according to claim 1, wherein the yarn signal fed for evaluation is obtained by multiplexing a plurality of partial signals obtained from a plurality of spinning stations.

3. A method according to claim 1, wherein the yarn signal is regulated to a constant signal level by means of a control amplifier whose gain is capable of being adjusted for different tex values.

4. A method according to claim 1, wherein a quotient is formed from the maximum and minimum values for the function value $Q(\tau)$ obtained within the said delay interval as a criterion for the presence of at least approximately periodic variations in the cross section in the yarn signal and this quotient is compared with a first reference value representing an allowable value.

5. A method according to claim 4, wherein a fault signal is produced if the said quotient exceeds the first reference value, through which fault signal the control of the operation of the spinning station is effected.

6. A method according to claim 2, wherein the average of the function values $Q(\tau)$ is formed over the said delay interval as a criterion for the size of the irregularity of the yarn signal and this average is compared to a reference value representing the maximum allowable irregularity.

7. A method according to claim 6, wherein a fault signal is produced when the average value of $Q(\tau)$ exceeds its respective reference value, thereby to indicate increased irregularity.

8. A method according to claim 2, wherein the maximum value of $Q(\tau)$ is formed over the said delay interval as a criterion for the size of the irregularity of the yarn signal and this maximum value is compared to a reference value representing the maximum allowable irregularity.

9. A method according to claim 8, wherein a fault signal is produced when the maximum value of $Q(\tau)$ exceeds its respective reference value, thereby to indicate increased irregularity.

10. A method according to claim 7, wherein the fault signal is demultiplexed synchronously with the multiplexing of the yarn signal to produce control signals which are identified in such a way that a specific control signal is allocated to the spinning station causing the fault signal.

11. A method according to claim 10, wherein the specific control signal acts on switching means which cause the spinning station operating faultily to come to a standstill and/or activate suitable indicators.

12. A method according to claim 1, wherein an autocorrelation function is formed from the yarn signals and that criteria for the presence of at least approximately periodic variations in cross section are obtained from the maximum and minimum values of the autocorrelation function appearing within the said delay interval.

13. An apparatus for controlling one or more spinning stations by evaluating yarn signals based on the detection of at least approximately periodic variations in yarn cross section, comprising an analog-digital converter for converting the yarn signals into digital signals; a microcomputer in which the sum of the differences between the original yarn signal and a yarn signal delayed by a time interval $\tau$ is continuously formed, the microcomputer further comprising means for producing specific fault signals from the summed differences and means for checking the fault signals against predetermined reference values; and switching means responsive to said microcomputer for controlling the spinning process at said spinning station if at least one reference value is exceeded.

14. An apparatus according to claim 13, comprising a multiplexer for multiplexing yarn signals from a plurality of yarn detectors, and a demultiplexer synchronized with the multiplexer for allocating the fault signals to the respective spinning stations.

15. An apparatus according to claim 13, comprising a control amplifier for controlling the yarn signal to have a constant input level for the microcomputer when testing yarns with different tex values.

16. An apparatus according to claim 13, said microcomputer includes means for displaying, individually or in combination, the intensity of the periodicity, period length and size of the irregularity.

17. An apparatus according to claim 16, wherein the characteristic values of a statistical evaluation obtained from the fault signals are stored and made obtainable.

18. An apparatus according to claims 13 or 16, wherein said microcomputer includes means for storing for later recall, individually or in combination, the intensity of periodicity, period length and size of the irregularity.

19. A method according to claims 1 or 12, wherein an autocorrelation function is formed from the yarn signals and that criteria for the size of the total irregularity of the yarn are obtained from the maximum and minimum values of the autocorrelation function appearing within the said delay interval.

* * * * *